US006006706A

United States Patent [19]

Kanzaki

[11] Patent Number: 6,006,706

[45] Date of Patent: Dec. 28, 1999

[54] METHOD AND APPARATUS FOR CONTROLLING VALVE MECHANISM OF ENGINE

[75] Inventor: Yoshiki Kanzaki, Oyama, Japan

[73] Assignee: Komatsu Ltd., Tokyo, Japan

[21] Appl. No.: 09/101,741

[22] PCT Filed: Dec. 25, 1996

[86] PCT No.: PCT/JP96/03795

§ 371 Date: Jul. 16, 1998

§ 102(e) Date: Jul. 16, 1998

[87] PCT Pub. No.: WO97/26447

PCT Pub. Date: Jul. 24, 1997

[30] Foreign Application Priority Data

Jan. 18, 1996 [JP] Japan ..... 8-24592

[51] Int. Cl.[6] ..... F01L 13/00

[52] U.S. Cl. ..... 123/90.15; 123/90.16; 123/90.22

[58] Field of Search ..... 123/90.12, 90.15, 123/90.16, 90.22, 90.4, 90.46, 90.55, 90.57

[56] References Cited

U.S. PATENT DOCUMENTS

| | | | |
|---|---|---|---|
| 4,924,821 | 5/1990 | Teerman | 123/90.22 |
| 5,499,606 | 3/1996 | Robnett et al. | 123/90.12 |
| 5,613,469 | 3/1997 | Rygiel | 123/90.16 |

FOREIGN PATENT DOCUMENTS

| | | |
|---|---|---|
| 59-181204 | 12/1984 | Japan . |
| 1-232103 | 9/1989 | Japan . |
| 1-044722 | 12/1989 | Japan . |
| 4-134113 | 5/1992 | Japan . |

*Primary Examiner*—Weilun Lo
*Attorney, Agent, or Firm*—Sidley & Austin

[57] ABSTRACT

A method and apparatus for controlling a valve mechanism of an engine, in which two stage control at engine start and during high-speed running simplifies a construction of the control apparatus, poor starting in high power engine is avoided at engine start and white smoke exhausted immediately after engine start is eliminated, while cylinder pressures due to high power are suppressed during high-speed running, the NOx exhaust gas produced is reduced because of combustion temperature decrease, and the compression pressure is decreased to reduce the loss of horsepower. A hydraulic intake valve operating angle varying device (12) is provided between the intake valve (11) of a valve mechanism (2) of the engine and a crosshead (9) so that the supply of pressurized oil to the valve mechanism is stopped at engine start, to decrease the lift and operating angle of the intake valve (11), to increase the effective compression ratio, and the pressurized oil is supplied to the valve mechanism during high-speed running, to increase the lift and operating angle of the intake valve (11), to decrease the effective compression ratio.

11 Claims, 4 Drawing Sheets

METHOD AND APPARATUS FOR CONTROLLING VALVE MECHANISM OF ENGINE

FIELD OF THE INVENTION

The present invention relates to a method and apparatus for controlling a valve mechanism of an engine, and more particularly to a method and apparatus for controlling a valve mechanism in which an intake valve of a diesel engine is opened or closed at a variable timing.

BACKGROUND OF THE INVENTION

Conventionally, there is known a valve driving gear, for arbitrarily and automatically controlling a valve, so as to open or close the valve at a variable timing, according to a rotary speed of an engine, with an arrangement of a hydraulic valve rush adjuster between a dynamic-system valve and a valve operating cam, for a gasoline engine for a car, for example, in Japanese Unexamined Patent Publication No. 1-232103.

A pivot portion of the valve driving gear is configured as shown in FIG. 5. In other words, there is shown a cylinder head 51, a cam 52, and an intake valve 53 (its stem portion). Between the cam 52 and the intake valve 53, there is provided a bucket 54 in a plunger insertion hole 51*a,* of the cylinder head 51, so as to be slidable, and a hydraulic valve rush adjuster 55 inside the bucket 54. With a rotation of the cam 52, the intake valve 53 is actuated for up-and-down strokes, through the bucket 54 and the hydraulic valve rush adjuster 55, so that the valve is opened or closed.

The hydraulic valve rush adjuster 55 forms a plunger 58 with a first adjuster portion 55A, which forms a middle-pressure chamber 56, positioned in the upper side, and two sets of adjuster members of a second adjuster portion 55B, which forms a high-pressure chamber 57, positioned in the lower side.

The first adjuster portion 55A comprises a first adjuster body 59A, a first valve spring 60, a first check ball 61, a first return spring 62, and a first check valve case 63.

The second adjuster portion 55B comprises a second adjuster body 59B, a second valve spring 64, a second check ball 65, a second return spring 66, and a second check valve case 67.

The first and second check balls 61 and 65 allow oil to flow from an oil reserve chamber 68 (described later) into the first and second adjuster bodies 59A and 59B, but do not allow it to flow out of the adjuster bodies.

The inside of the bucket 54, and a guide member 69, for guiding the above plunger 58, form the oil reserve chamber 68. This oil reserve chamber 68 has communication with an oil passage 71 of the cylinder head 51 through an oil inlet 70, provided in the side portion of the bucket 54, and has communication with the interior of the first and second adjuster bodies 59A and 59B through an oil outlet 72, provided on an inner wall of the top of the bucket 54.

Oil from the oil passage 71, of the cylinder head 51, is supplied to the oil reserve chamber 68, and then is necessarily supplied to the middle-pressure chamber 56, through the first check ball 61, from the interior of the first adjuster body 59A. The oil in the middle-pressure chamber 56 is supplied to the high-pressure chamber 57, through the second check ball 61, from the interior of the second adjuster body 59.

A volumetric rate regulation spring 73 is formed by two springs, an inner spring 74 and an outer spring 75, which have a considerably strong spring force (high hardness) relative to the first return spring 62, and is used so that a volume of the middle-pressure chamber 56 is always maintained at a fixed value, while the intake valve 53 is seated.

Next, an operation of this construction will be explained. The hydraulic valve rush adjuster 55, between the intake valve 53 and the cam 52, runs with two sets of adjuster members of the first adjuster portion 55A and the second adjuster portion 55B, which are combined to operate with each other. While an oil leak amount from the high-pressure chamber 57, of the second adjuster portion 55B, is set to a value smaller than an oil leak amount from the middle-pressure chamber 56, of the first adjuster portion 55A, a spring force of the second return spring 66, of the second adjuster portion 55B, is set to a value greater than a spring force of the first return spring 62. In other words, the hydraulic valve rush adjuster 55, which is provided between the cam 52 and the intake valve 53, to be opened by the cam 52 and intended for automatically adjusting a valve rush of the intake valve 53, adjusts oil leak amounts of respective oil chambers 56 and 57, in the side of the second adjuster portion 55B, when the cam 55 is running to values smaller than those in the side of the first adjuster portion 55A, by means of two sets of the adjuster members, the first adjuster portion 55A having the middle-pressure chamber 56 and the second adjuster portion 55B having the high-pressure chamber 57, which are provided with different properties.

This makes it possible to realize accurate dynamic properties, which determine an initial sinking amount in the first adjuster portion 55A, and to realize static properties in the second adjuster portion 55B, having an less oil leak amount. In addition, the spring force of the second return spring 66 is greater than the spring force of the first return spring 62, and therefore an initial volume of the middle-pressure chamber 56 is set very accurately, and a fluctuation of an initial value is reliably absorbed. It is described that, therefore, valve timing can be arbitrarily and automatically controlled with variable settings according to a rotary speed of the engine.

This case of the conventional engine valve driving gear, however, has the following problems:

(1) This engine valve driving gear is a gasoline engine for a car, having the hydraulic valve rush adjuster 55 between the cam 52 and the intake valve 53, to be opened by the cam 52. The gasoline engine for a car has a speed fluctuation from low to high speeds. Therefore, the valve timing is arbitrarily and automatically controlled with variable settings according to the rotary speed of the engine.

Accordingly, the hydraulic valve rush adjuster 55 is operated by two sets of adjuster members, the first adjuster portion 55A (in the cam side) and the second adjuster portion 55B (in the valve side) being combined with each other for the operation. In other words, the hydraulic valve rush adjuster 55, for automatically adjusting a valve rush of the intake valve 53, adjusts oil leak amounts of respective oil chambers 56 and 57 in the second adjuster portion 55B when the cam 55 is running to values smaller than those in the first adjuster portion 55A, by means of two sets of the adjuster members, the first adjuster portion 55A having the middle-pressure chamber 56 and the second adjuster portion 55B having the high-pressure chamber 57, which are provided with different properties.

The oil leak amount, however, depends upon an oil viscosity and a gap (first and second oil leak passages). In other words, the oil viscosity depends upon an oil service temperature during operation and, as to gaps, it is difficult to manage the unevenness of a dimensional accuracy of components in the hole side and in the shaft side, and therefore, the oil leak amount is not fixed. Furthermore, this valve driving gear is operated by two sets of adjuster members, the first adjuster portion 55A and the second adjuster portion 55B, in which the hydraulic valve rush adjuster 55 has a large number of components in a complicated construction.

(2) In recent years, there has been used a generator and a cogeneration system (an apparatus for supplying hot-water and electricity) driven by a diesel engine. A rotary speed of an engine used for this product is different from the rotary speed of the engine for a car. It does not have a speed variation from a low speed to a high speed, and it is always running at a fixed rotary speed.

On the other hand, as a countermeasure for an improvement of increased power and exhaust gas properties, it is necessary to increase a lift of the intake valve 53 of the valve mechanism, at a high-speed rated output, in order to increase its operating angle and to decrease its effective compression ratio (cylinder volume/compression volume), in order to improve a performance of power and exhaust gas properties, so as to suppress the pressure in the cylinder. In addition, at engine start, it is necessary to decrease the lift of the intake valve 53 in order to decrease its operating angle and to increase its effective compression ratio, in order to improve its engine start properties. In other words, it is required to have variable operating angles and effective compression ratios of the intake valve 53 during high-speed running and at engine start.

A control and apparatus for controlling an engine valve mechanism which satisfies these quality requirements and has a simple construction is greatly needed.

SUMMARY OF THE INVENTION

With a view of highlighting the conventional problems, it is an object of the present invention to improve a performance of an engine, which is operated always at a fixed rotary speed for a generator and a cogeneration system (an apparatus for supplying both of hot water and electricity), driven by a diesel engine.

In other words, a lift of an intake valve of a valve mechanism is increased at a high-speed rated output in order to increase an operating angle of the intake valve, and its effective compression ratio is decreased in order to suppress a pressure in a cylinder, so as to improve a performance of power and NOx exhaust gas properties. In addition, at engine start, the lift of the intake valve is decreased in order to reduce an operating angle of the intake valve and to increase its effective compression ratio, in order to improve its engine start properties. It is an object of the present invention to provide a method and apparatus for controlling an engine valve mechanism which satisfies these quality requirements and has a simple construction.

As to a first aspect of a method of controlling a valve mechanism of an engine of the present invention, there is provided a control method of a valve mechanism of an engine, having a hydraulic mechanism whose valve lift is variable between an engine dynamic-system valve and a valve operating cam, in which a supply of pressurized oil to a hydraulic intake valve operating angle varying device is stopped at the starting of the engine to decrease a lift of an intake valve of the hydraulic intake valve operating angle varying device, in order to reduce an operating angle of the intake valve. During high-speed running of the engine, the pressurized oil is supplied to the hydraulic intake valve operating angle varying device to increase the lift of the intake valve of the hydraulic intake valve operating angle varying device, in order to increase the operating angle of the intake valve. At the stopping of the engine, the supply of pressurized oil to the hydraulic intake valve operating angle varying device is stopped, and the engine is operated in low idling for a given time to decrease the lift of the intake valve of the hydraulic intake valve operating angle varying device, so as to reduce the operating angle of the intake valve.

In this construction, it becomes possible to increase an effective compression ratio (for example, to around 14) by decreasing the operating angle of the intake valve at engine start, which resolves a problem of poor starting in a high power engine and of white smoke exhausted immediately after engine start, which generally has a very irritating odor. Furthermore, during high-speed running, an increase of the operating angle of the intake valve makes it possible to decrease the effective compression ratio (for example, to around 10), by which the cylinder pressures due to high power are suppressed; the properties of the NOx or other exhaust gases produced are improved, because of a combustion temperature decrease; the compression pressure decreases; and the loss of horsepower is reduced. In this manner, with an application of a variable operating angle of the intake valve and a variable effective compression ratio at engine start and during high-speed running, the problems of the properties are resolved at engine start and during high-speed running and more reactive controls can be achieved.

As to a first aspect of an apparatus of controlling a valve mechanism of an engine of the present invention, an apparatus for controlling a valve mechanism of an engine having a hydraulic mechanism, whose valve lift is variable between a dynamic-system valve and a valve operating cam, comprises a hydraulic intake valve operating angle varying device provided between an intake valve of the valve mechanism and a crosshead, a pump for the supply of pressurized oil to the hydraulic intake valve operating angle varying device, a switching means for switching the supply of pressurized oil from the pump, and a controller for outputting a command signal for turning off the switching means at start or stop of the engine and for turning on the switching means during high-speed running of the engine.

In this embodiment, the problems of the properties at engine start and during high-speed running are resolved in the same manner as for the control method.

According to a second aspect of an apparatus for controlling a valve mechanism of an engine of the present invention, an apparatus for controlling a valve mechanism of an engine comprises a controller for outputting a command signal for running the engine in low idling for a given time at engine stop.

In this embodiment, the engine is stopped passing through a rated load low-idling state at engine stop, and therefore it becomes possible to discharge oil reliably from a piston chamber of the hydraulic intake valve operating angle varying device, provided in the crosshead of the valve mechanism, by which the engine can be easily restarted. In addition, a rotary speed of a turbo-charger is decreased before the engine is stopped, and therefore a bearing of the turbo-charger can be prevented from seizing.

According to a third aspect of an apparatus for controlling a valve mechanism of an engine of the present invention, the hydraulic intake valve operating angle varying device, provided at both ends of the T-shaped crosshead, comprises a piston chamber having a discharge orifice, a piston inserted into the piston chamber with a small amount of clearance; a spring for pressing the piston to the intake valve; a spring support inserted into the piston chamber for supporting the spring; a ball-shaped check valve in contact with the spring support; and a plunger inserted into the interior of the piston with a small amount of clearance and having a passage hole in a central portion and a taper in the lower part thereof.

In this embodiment, the same improvement as for the first aspect of the control apparatus is achieved, and it requires less components, so that the construction is simplified. In addition, even if a very small amount of oil leaks out of a gap in the piston when the intake valve is open, the check valve opens to fill the reduction when the intake valve is closed, and therefore it is easy to manage the unevenness of dimensional accuracy of the hole-side components and the shaft-side components. Furthermore, the taper is provided in a lower part of the passage hole, in the central portion of the plunger, so that an oil pressure is applied to a lower part of the ball of the check valve when a pressure in the piston chamber is increased, by which the apparatus is very reactive to an increase of the pressure in the piston chamber. It makes it possible to minimize a leak loss when lifting the intake valve.

According to a fourth aspect of an apparatus for controlling a valve mechanism of an engine of the present invention, the discharge orifice in the piston chamber is closed when the piston moves up by a given height, and an air accumulation, which serves as an air cushion, is formed in the upper part of the piston.

In this embodiment, an impact sound can be decreased, and durability can be improved, by absorbing a seating shock when the feeding oil operation is set to OFF.

DETAILED DESCRIPTION OF THE PREFERRED EMBODIMENTS

Embodiments of the present invention will be described in detail below by using FIGS. 1 to 4.

Figure 1:
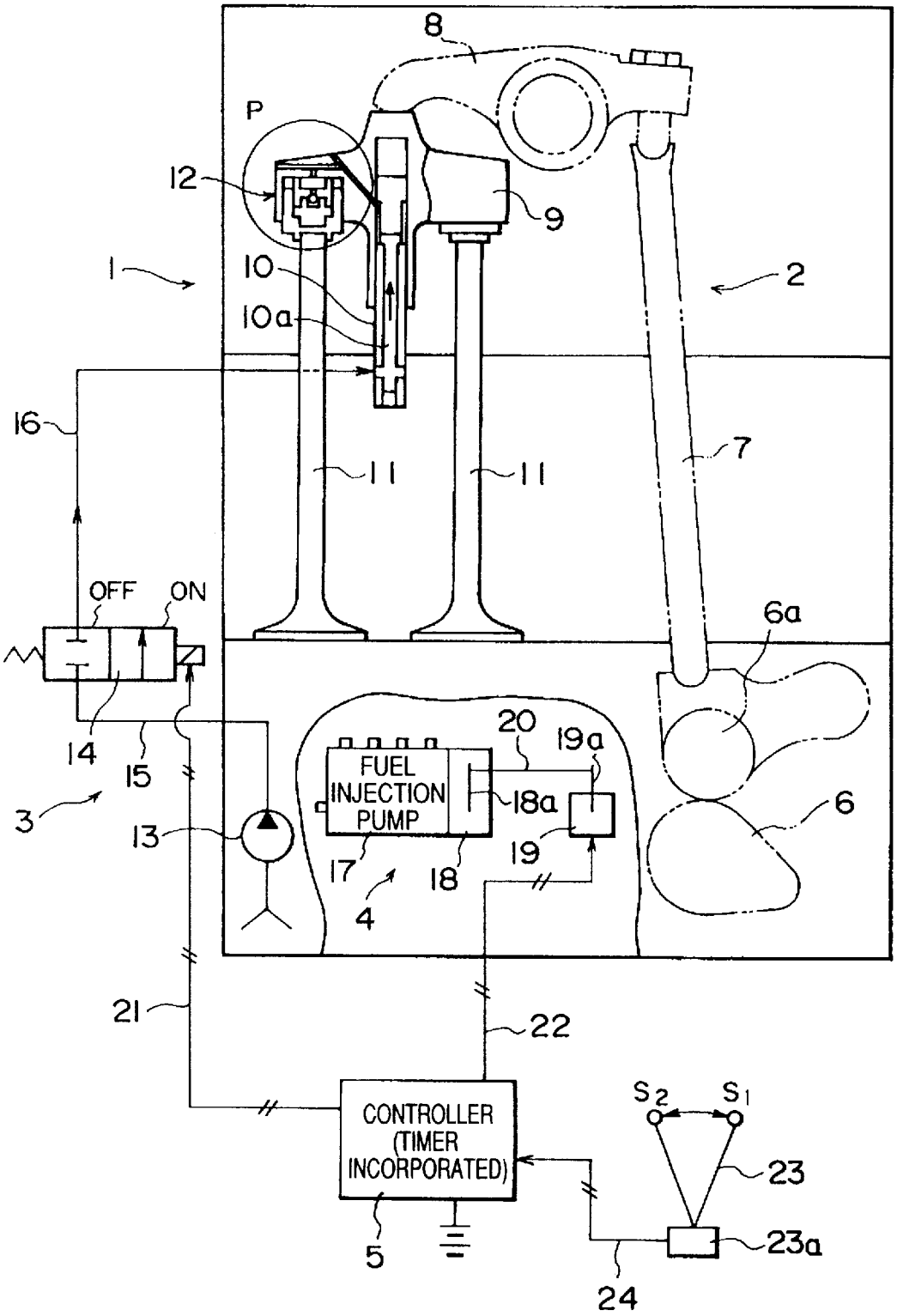
FIG. 1 is a schematic view of an apparatus for controlling a valve mechanism of an engine according to the present invention.

As shown in FIG. 1, an apparatus 1, for controlling a valve mechanism of an engine, comprises a valve mechanism 2, an oil feeder 3, a fuel injector 4, and a controller 5 for controlling these units.

The valve mechanism 2 comprises a camshaft 6, a cam follower 6*a,* a push rod 7, a rocker arm 8, a crosshead 9 a support pin 10 for the cross head 9, and intake valves 11 and 11.

At both ends of the T-shaped crosshead 9, hydraulic intake valve operating angle varying devices 12 and 12 (described later) are incorporated. The support pin 10, of the crosshead 9, is provided with a passage hole 10*a* for feeding oil.

The oil feeder 3 comprises a pump 13 for feeding pressurized oil into the valve mechanism 2 and an electromagnetic valve 14, which is a switching means for switching an oil reception from a pump 13. The pump 13 is connected to the electromagnetic valve through piping 15, and the electromagnetic valve 14 is connected to the support pin 10, of the crosshead 9, via piping 16.

The fuel injector 4 comprises a fuel injecting pump 17, a governor 18, and an actuator 19. A lever 18*a,* of the governor 18, is connected to a lever 19*a,* of the actuator 19, through a rod 20.

The controller 5 is connected to the electromagnetic valve 14 through wiring 21, and the controller 5 is connected to the actuator 19 through wiring 22.

A control lever 23, for starting or stopping an engine, is provided with a potentiometer 23*a* for detecting a position signal. This potentiometer 23*a* is connected to the controller 5 through wiring 24.

Figure 2:
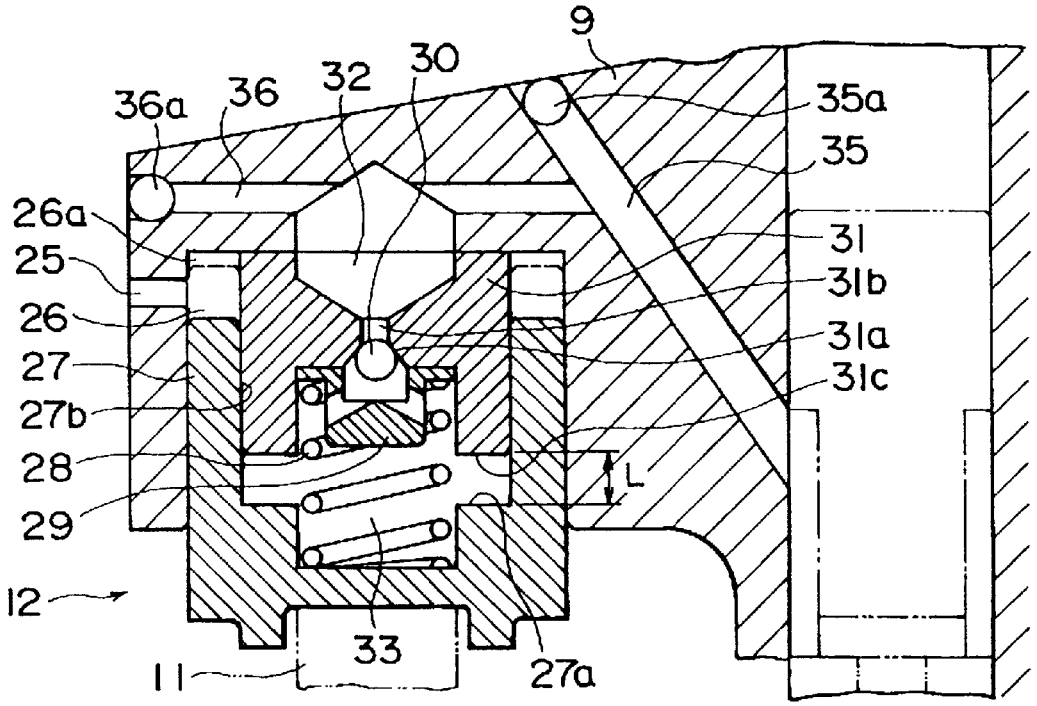
FIG. 2 is a cross-section of an enlarged P portion, shown in FIG. 1.

Next, an embodiment of the hydraulic intake valve operating angle varying device 12 is explained below by using an expanded sectional view in FIG. 2.

The hydraulic intake valve operating angle varying device 12 is located at an end of the crosshead 9 and is mounted between the crosshead 9 and the intake valve 11. The hydraulic intake valve operating angle varying device 12 comprises a piston chamber 26 having a discharge orifice 25; a piston 27 inserted into the piston chamber 26 with a small amount of clearance; a spring 28 for pressing the piston 27 to the intake valve 11; a spring support 29, inserted into the plunger 31 for supporting the spring 28; a ball-shaped check valve 30 in contact with the spring support 29; and a plunger 31, inserted into the piston 27 inward with a small amount of clearance.

The plunger 31 and the piston 27 form a high-pressure chamber 33.

A reservoir 32 is formed in an upper part of the plunger 31, and a taper 31*a,* in contact with the check valve 30, is formed in the central portion of its lower part, provided with a passage hole 31*b* for communication of the reservoir 32 with the taper 31*a.*

The crosshead 9 is provided with passage holes 35 and 36, for feeding oil with their apertures to the outside, covered with plugs 35*a* and 36*a,* respectively.

In this embodiment, an operation of the hydraulic intake valve operating angle varying device 12 is described below.

Figure 4:
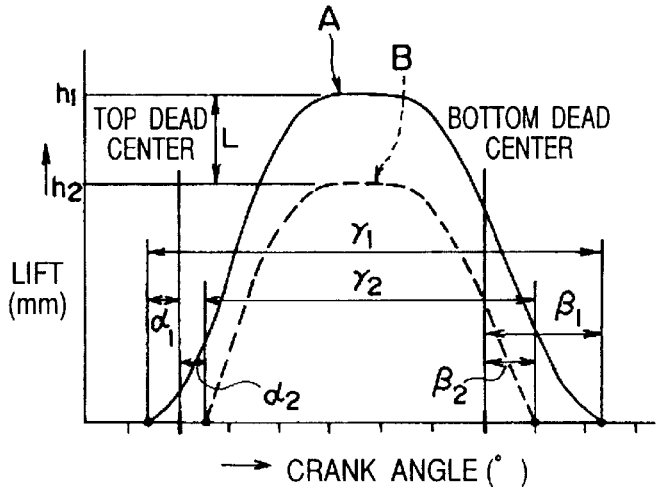
FIG. 4 is a diagram for explaining a relationship between a lift of an intake valve and valve open-close timing of a crank angle of the control apparatus according to the present invention.
Figure 5:
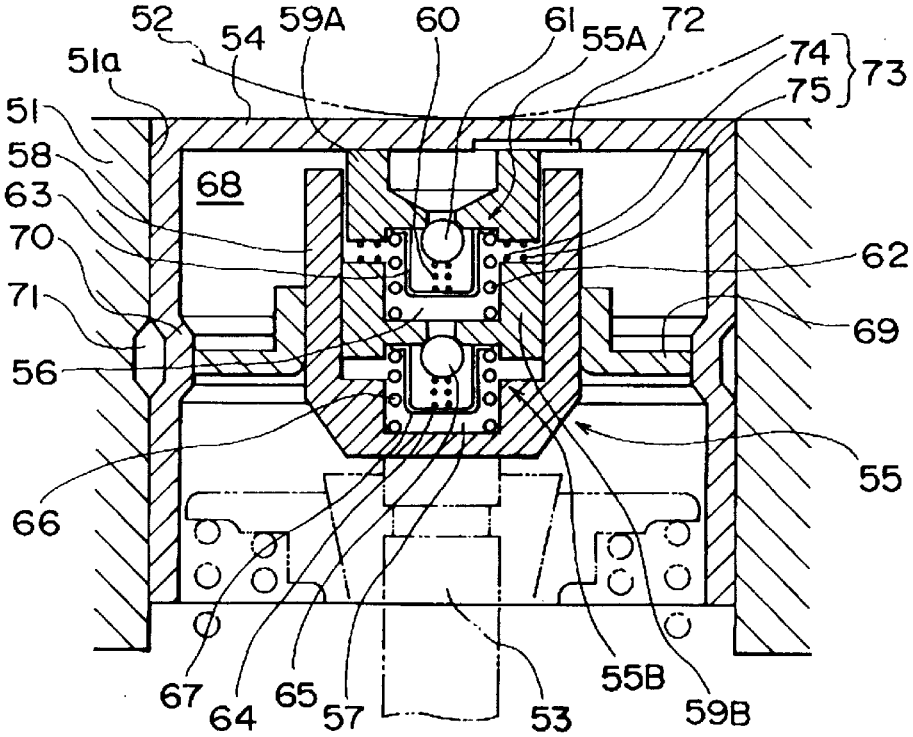
FIG.5 PRIOR ART
FIG. 5 is a cross-section of a valve mechanism of a prior art engine.

The hydraulic intake valve operating angle varying device 12 controls a lift of the intake valve 11 in two stages, that is, during high-speed running and at engine start, by turning on or off the pressurized oil, so that an operating angle of the intake valve 11 is caused to be variable. As to a relationship between the lift of the intake valve 11 and the operating angle, if it is assumed that a lift (mm) of the intake valve 11 is applied to an ordinate axis, and a crank angle (°)is to an abscissa axis, as shown in FIG. 4, a solid line A indicates an operational diagram of a valve lift during high-speed running, and a dotted line B indicates an operational diagram of a valve lift at engine start. In the operational diagram A of the valve lift during high-speed running, the intake valve 11 begins to open at a $\alpha_1$°, previous to a top dead center of the crank angle, reaches the maximum lift of $h_1$ mm, and closes at $\beta_1$°, subsequent to a bottom dead center with an operating angle $\gamma_1$. In the operational diagram B of the valve lift at engine start, the intake valve 11 begins to open at a $\alpha_2$°, subsequent to the top dead center of the crank angle, reaches the maximum lift of $h_2$ mm, and closes at $\beta_2$°, subsequent to the bottom dead center with an operating angle $\gamma_2$. In this manner, the lift of the valve mechanism 2 is increased to enlarge the operating angle $\gamma_1$ during high-speed running, while the lift of the valve mechanism 2 is decreased ($L=h_1-h_2$ smaller than the lift during high-speed running) to reduce the operating angle $\gamma_2$ at engine start, so that the operating angles during high-speed running and at engine start are caused to be variable. Particularly, the following operation is performed:

(1) The supply of pressurized oil to the hydraulic intake valve operating angle varying device 12 is stopped at engine start to decrease the lift $h_2$ of the intake valve 11, so as to reduce its operating angle $\gamma_2$. In other words, the high-pressure chamber 33 of the hydraulic intake valve operating angle varying device 12 is made empty; a lower end 31*c* of the plunger 31 pressurizes an inner end bottom 27*a* from a camshaft 6 via a cam follower 6*a,* a push rod 7, a rocker arm 8, and a crosshead 9; a stroke L is closely put into contact with each other by means of a spring force of the spring 28; and then the intake valve 11 is lifted. In this condition, the lift $h_2$ and $\gamma_2$ of the intake valve 11 is smaller by the amount of the stroke L.

(2) The pressurized oil is supplied to the hydraulic intake valve operating angle varying device 12 during high-speed running to increase the lift $h_1$ of the intake valve 11, so as to increase its operating angle $\gamma_1$. In other words, the pressurized oil to the hydraulic intake valve operating angle varying device 12 is supplied for filling from the pump 13, to the high-pressure chamber 33, with the electromagnetic valve 14 set on, passing through the piping 15, the electromagnetic valve 14, the piping 16, the oil passage 10 of the support pin in the crosshead, the passage holes 35 and 36 of the crosshead 9, and the reservoir 32. At this time, the high-pressure chamber 33 becomes very similar to a rigid body, and therefore, the operation of the intake valve 11 reaches the high lift $h_1$. When the intake valve 11 is opened by a pressing force of the rocker arm 8, a very small amount of oil leaks out of the gap 27*b* of the piston 27. When the intake valve 11 is closed, however, the check valve 30 is opened due to a pressure difference between the high-pressure chamber 33, pressurized by a spring force of the spring 28, and the reservoir 32, to supplement the pressurized oil for filling into the high-pressure chamber 33.

The engine is run in low idling at engine stop, for a given time in a control method (described later), and pressurized oil in the high-pressure chamber 33 is intentionally leaked, to be emptied, in preparation for engine restart.

When the engine is running with the lower end portion 31*c* of the plunger 31 closely in contact with the inner end bottom 27*a* of the piston 27, the discharge orifice 25 is closed when the piston 27 is lifted by a given height, by which an air accumulation 26*a* is formed which serves as an air cushion. This air cushioning action absorbs and relieves a seating shock, by which an impact sound is reduced and durability is improved.

In addition, the hydraulic intake valve operating angle varying device 12 has a rush adjuster function of always maintaining a valve clearance of zero (0).

Figure 3:
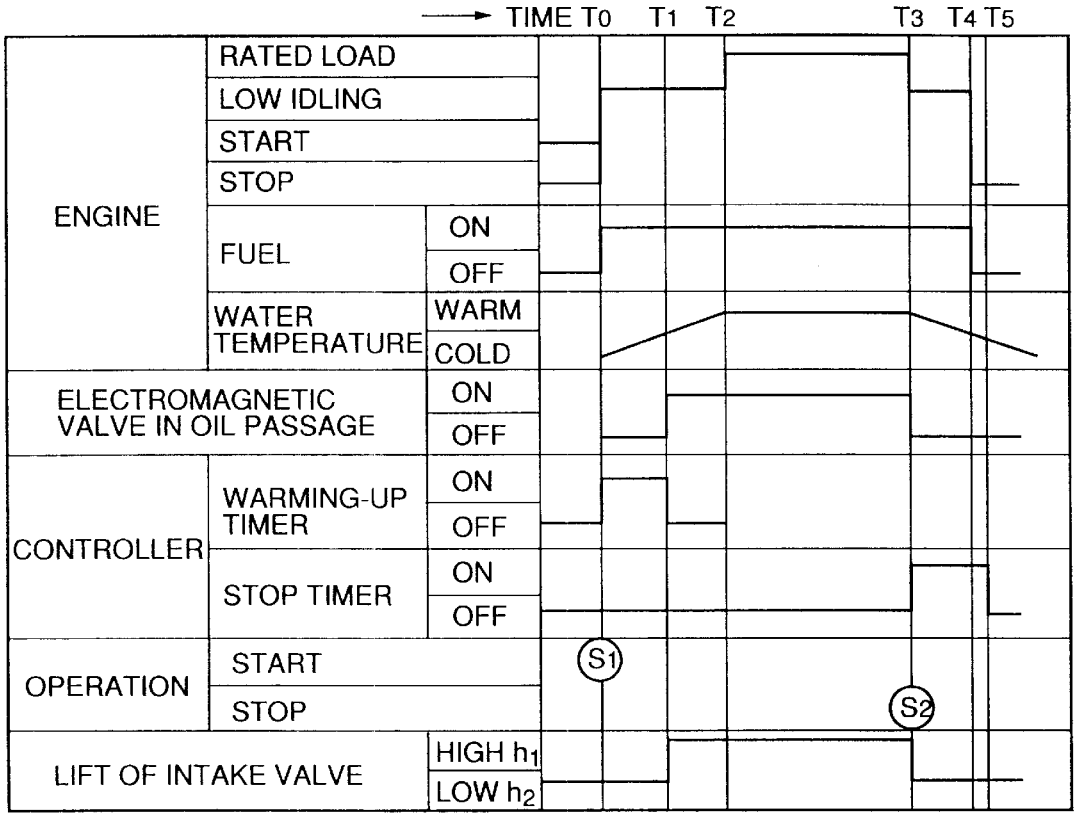
FIG. 3 is a diagram for explaining a relationship between operation items and timing of a control method according to the present invention.

Next, the control method is explained by using FIGS. 1 and 3. The ordinate axis in FIG. 3 indicates operation items and the abscissa axis indicates their timing.

(1) At engine first start, the control lever 23 is set to a start position $S_1$. At this point, a signal is outputted from the potentiometer 23*a* for detecting a position signal to the controller 5 via the wiring 24. A command signal is outputted from the controller 5, to the actuator 19, via the wiring 22. Then, the lever 19*a* of the actuator 19, which has been stopped, moves to a low-idling position, to set the governor 18 to the low-idling position, through the rod 20 and the lever 18*a* of the governor 18.

(2) A start switch (which is not shown) is set ON, to start the engine, and low-idling running is started. In other words, a state at time $T_0$ in FIG. 3 is achieved. Simultaneously with the start of the low-idling running, a warming-up timer of the controller 5 is set ON and the electromagnetic valve 14, in the oil passage, is put in an OFF state. Therefore, the supply of pressurized oil to the hydraulic intake valve operating angle varying device 12 is stopped, and both the lift h2 and the operating angle $\gamma_2$, of the intake valve 11, are small.

(3) After an elapse of a given time $T_1$ with low-idling running, the timer of the controller 5 operates to set the electromagnetic valve 14 to ON, in the oil passage, by which pressurized oil is supplied to the hydraulic intake valve operating angle varying device 12 to increase the lift $h_1$ of the intake valve 11, so as to increase its operating angle $\gamma_1$.

(4) Further, after an elapse of a given time $T_2$ with low-idling running, the timer of the controller 5 operates to increase the engine speed automatically. In other words, a command signal is outputted from the controller 5, to the actuator 19, via the wiring 22. The lever 19*a,* of the actuator 19, moves from the low-idling position to the high-speed position, and the governor 18 shifts to the high-speed position via the rod 20 and the lever 18*a*. Afterward, a generator and a cogeneration system (an apparatus for supplying both of hot water and electricity) are loaded externally and the engine is run at a rated load. The engine may be provided with a water temperature sensor (which is not shown), so that a command signal of increasing the engine speed is output based on the signal from the water temperature sensor when a water temperature reaches a given temperature or higher at time $T_2$.

(5) To stop the engine, the control lever 23 is set to a stop position $S_2$ at time $T_3$. At this point, a signal is outputted from the potentiometer 23*a,* for detecting a position signal, to the controller 5, via the wiring 24. One signal is entered from the controller 5, to the actuator 19, via the wiring 22. The lever 19*a* of the actuator 19 moves from the high-speed position to the low-idling position, and the governor 18 starts running in the low-idling position, via the rod 20 and the lever 18*a* of the governor 18. Then, the other signal is transmitted from the controller 5 via the wiring 21, to switch the electromagnetic valve 14 in the oil passage from the ON state to the OFF state. This operation stops the supply of pressurized oil to the hydraulic intake valve operating angle varying device 12, by which both of the lift $h_2$ and the operating angle $\gamma_2$ of the intake valve 11 are decreased. In this condition, the engine is run in low idling. In addition, the stop timer of the controller 5 is set on at time $T_3$ to operate.

(6) After the stop timer starts to operate, a command signal is outputted from the controller 5 to the actuator 19 via the wiring 22, at time $T_4$, subsequent to a low-idling running for a given time. Then, the lever 19*a* of the actuator 19 moves from the low-idling position to the stop position, and the governor 18 shifts to the stop position, via the rod 20 and the lever 18*a* of the governor 18, by which the fuel supply is set to OFF to stop the engine. Afterward, the stop timer is set to OFF at time $T_5$.

In this control method, the effective compression ratio is increased by decreasing the operating angle $\gamma_2$, Of the intake valve 11, at engine start, and it is decreased by increasing the operating angle $\gamma_1$, of the intake valve 11, during high-speed running. Therefore, it becomes possible to achieve two stage control at engine start and during high-speed running, by which the operating angle and the effective compression ratio of the intake valve 11 are caused to be variable.

According to the present invention, the construction of the control apparatus is simplified by the two stage control at engine start and during high-speed running, and poor starting at engine start is avoided, though it has been a problem in a high power engine, which eliminates a problem of white smoke exhausted immediately after engine start, which generally has a very irritating odor. In addition, during high-speed running, cylinder pressures due to high power are suppressed, the properties of NOx or other exhaust gases produced are improved because of combustion temperature decrease, and the compression pressures are decreased to reduce the loss of horsepower, by which fuel consumption is decreased. As a result, it becomes possible to improve an engine, which is always run at a fixed rotary speed, for a generator and a cogeneration system (an apparatus for supplying both of hot water and electricity), driven by a diesel engine.

INDUSTRIAL APPLICABILITY

The present invention improves engine performance for a generator and a cogeneration system (an apparatus for supplying both of hot water and electricity), driven by a diesel engine. In other words, two stage control at engine start and during high-speed running simplifies a construction of the control apparatus, avoids poor starting which is a problem in a high power engine at engine start, and eliminates a problem of white smoke exhausted immediately after engine start, which generally has a very irritating odor. During high-speed running, cylinder pressures due to high power are suppressed, the properties of NOx or other exhaust gases produced are improved because of a combustion temperature decreases and the compression pressure is decreased to reduce the loss of horsepower, by which fuel consumption is decreased. The present invention is useful as a method and apparatus for controlling a valve mechanism of an engine as set forth in the above.

What is claimed is:

1. An apparatus for controlling an intake valve mechanism of an engine, comprising:

a first valve operating angle varying device disposed between a first end of a crosshead and a first intake valve of said intake valve mechanism;

a pump for pressurizing oil;

means for switching oil pressurized by said pump to said first valve operating angle varying device; and a controller for outputting a plurality of signals, wherein a first of said plurality of signals is outputted by said controller, when said engine is in high speed operation, so as to cause said means for switching to turn on said oil to said first valve operating angle varying device;

wherein a second of said plurality of signals is outputted by said controller, when said engine is being started or stopped, so as to cause said means for switching to turn off said oil to said first valve operating angle varying device; and wherein a third of said plurality of signals is outputted by said controller, when said engine is being started or stopped, so as to cause said engine to operate in low idling for a given period of time.

2. An apparatus for controlling an intake valve mechanism of an engine, as claimed in claim 1, wherein said means for switching is an electromagnetic valve.

3. An apparatus for controlling an intake valve mechanism of an engine, as claimed in claim 1, wherein said third of said plurality of signals causes an actuator to set a governor to a low-idling position, so as to cause said engine to operate in low idling for a given period of time.

4. An apparatus for controlling an intake valve mechanism of an engine, as claimed in claim 1, wherein said engine is a diesel engine.

5. An apparatus for controlling an intake valve mechanism of an engine, as claimed in claim 1, further comprising:

a second valve operating angle varying device disposed between a second end of a crosshead and a second intake valve of said intake valve mechanism;

wherein said means for switching said oil also switches said oil to said second operating angle varying device;

wherein said first of said plurality of signals is outputted by said controller, when said engine is in high speed operation, so as to also cause said means for switching to turn on said oil to said second valve operating angle varying device; and wherein said second of said plurality of signals is outputted by said controller, when said engine is being started or stopped, so as to also cause said means for switching to turn off said oil to said second valve operating angle varying device.

6. An apparatus for controlling an intake valve mechanism of an engine, as claimed in claim 1, said first intake valve operating angle varying device comprising:

a piston chamber having a discharge orifice;

a piston inserted into said piston chamber;

a spring in contact with said piston for pressing said piston onto said first intake valve;

a plunger inserted into an interior portion of said piston, said plunger having a passage hole in a central portion, wherein a lower part of said passage hole is tapered;

a spring support inserted into an interior portion of said plunger for supporting said spring; and a check valve disposed between said plunger and said spring support for regulating a flow of oil through said passage hole of said plunger.

7. An apparatus for controlling an intake valve mechanism of an engine, as claimed in claim 6, wherein said discharge orifice is closed and an accumulation of air is formed in an upper portion of said piston chamber when said piston moves up by a given height.

8. An apparatus for controlling an intake valve mechanism of an engine, as claimed in claim 6, wherein said check valve is closed to prevent said oil from flowing through said passage hole of said plunger when said oil is turned on to said first valve operating angle varying device and said first intake valve is in an open state, and wherein said check valve is open to allow said oil to flow through said passage hole of said plunger when said oil is turned on to said first valve operating angle varying device and said first intake valve is in a closed state.

9. A method of controlling an intake valve mechanism of an engine, comprising the steps of:

preventing oil from flowing to a valve operating angle varying device, at the starting and stopping of said engine, to decrease a lift of an intake valve;

allowing said oil to flow to said valve operating angle varying device, during high-speed running of said engine, to increase the lift of said intake valve; and causing said engine to run in low idling for a given period of time at the stopping of said engine.

10. A method of controlling an intake valve mechanism of an engine, as claimed in claim 9, further comprising the steps of:

sensing a signal representing the position of a control lever, said control lever for controlling the starting and stopping of said engine; and outputting a signal to a means for switching said oil to said valve operating angle varying device.

11. A method of controlling an intake valve mechanism of an engine, comprising the steps of:

sensing a signal indicating a starting of said engine;

setting a governor to a low-idling position so as to cause said engine to run in low idling upon sensing said signal indicating the starting of said engine;

starting said engine;

starting a warming-up timer;

setting an electromagnetic valve to an OFF state, said electromagnetic valve for switching a flow of oil;

setting said electromagnetic valve to an ON state after said timer has timed a first given period of time;

setting said governor to a high-speed position so as to cause said engine to run at high speed after said timer has timed a second given period of time;

sensing a signal indicating a stopping of said engine;

setting said governor to a low-idling position so as to cause said engine to run in low idling upon sensing said signal indicating the stopping of said engine;

setting said electromagnetic valve to an OFF state upon sensing said signal indicating the stopping of said engine; and stopping said engine after said timer has timed a third given period of time.

* * * * *

UNITED STATES PATENT AND TRADEMARK OFFICE

CERTIFICATE OF CORRECTION

PATENT NO. : 6,006,706
DATED : December 28, 1999
INVENTOR(S) : Yoshiki Kanzaki

It is certified that error appears in the above-identified patent and that said Letters Patent is hereby corrected as shown below:

Claim 1,
Line 17, before "stopped", insert -- being --.

Claim 5,
Line 4, delete "a", and insert -- said --.
Line 5, after "mechanism", delete ";", and insert -- , --.

Claim 10,
Line 5, before "for", insert -- being --.

Claim 11,
Line 10, before "for", insert -- being --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*